US008418586B2

(12) United States Patent
Feigel, Jr. et al.

(10) Patent No.: US 8,418,586 B2
(45) Date of Patent: Apr. 16, 2013

(54) POWER TONG WITH DOOR JAMMER VALVE

(75) Inventors: Kurt R. Feigel, Jr., Edmonton (CA); Marcin K. Barker, Edmonton (CA)

(73) Assignee: Universe Machines Corporation, Edmonton (CA)

( * ) Notice: Subject to any disclaimer, the term of this patent is extended or adjusted under 35 U.S.C. 154(b) by 246 days.

(21) Appl. No.: 12/862,616

(22) Filed: Aug. 24, 2010

(65) Prior Publication Data

US 2011/0296957 A1 Dec. 8, 2011

(51) Int. Cl.
*B25B 13/50* (2006.01)

(52) U.S. Cl.
USPC ..... 81/57.15; 81/57.33

(58) Field of Classification Search ..... 81/57.11, 81/57.15, 57.16, 57.22, 57.24, 57.34, 57.35, 81/57.33, 57.44; 173/1, 2, 11, 213, 218, 173/171

See application file for complete search history.

(56) References Cited

U.S. PATENT DOCUMENTS 5,535,645 A * 7/1996 Penisson ..... 81/57.33
6,439,316 B1 * 8/2002 Penisson ..... 173/1
8,109,179 B2 * 2/2012 Richardson ..... 81/57.11

OTHER PUBLICATIONS

"Basic Door Jammer Hydraulic Door Lockout System," Owners Manual, Model: DJ 05UN1002, 5.5 Universe Tubing Tong, Rev. 1, ModTek Manufacturing Corporation, Edmonton, Canada, Sep. 2006, 11 pages.

* cited by examiner

*Primary Examiner* — Robert Pezzuto
(74) *Attorney, Agent, or Firm* — Christensen O'Connor Johnson Kindness PLLC

(57) ABSTRACT

An apparatus for shutting off the hydraulic supply of a power tong when the door is opened comprises, in part, a ring gear and cage assembly having a throat. The ring gear and cage assembly are driven by a motor having a hydraulic supply. A door is mounted on a pivot on the ring gear and cage assembly for movement to open and close the throat. A cable is secured to the door at a point that is offset from the pivot. The cable extends through a sleeve to a valve end of the cable. A valve at the valve end of the cable has a valve housing and is operable by movement of a valve control to disengage the hydraulic supply from the motor. The valve end of the cable is connected to the valve control and the sleeve is connected to the valve housing.

2 Claims, 2 Drawing Sheets

POWER TONG WITH DOOR JAMMER VALVE

TECHNICAL FIELD

Generally, hydraulic supplies for power tongs, and specifically valves for use with the hydraulic supplies.

BACKGROUND

Universe Machine Corporation has for many years supplied power tongs into the Canadian and United States oil field market place. The power tongs have a throat for receiving an oilfield tubular. A ring gear driven by motors engages the oilfield tubular. A hydraulic system supplies hydraulic power fluid to motors that drive the ring gears. To prevent the oilfield tubular exiting the throat of the power tong during use, the throat has a gate or door. Cable or hydraulic mechanisms have been used to shut off the hydraulic supply to the motors when the gate or door is opened. Cable mechanisms sold recently by Universe Machine Corporation have used a two piece valve shut off that is difficult to adjust.

SUMMARY

There is provided a power tong with a cable operated door jammer valve for shutting off the hydraulic supply of a power tong when the door is opened. In an embodiment, there is provided a power tong comprising a ring gear and cage assembly having a throat, the ring gear and cage assembly being driven by a motor having a hydraulic supply, a door mounted on a pivot on the ring gear and cage assembly for movement to open and close the throat, a cable secured to the door at a point that is offset from the pivot, the cable extending through a sleeve to a valve end of the cable, a valve at the valve end of the cable, the valve having a valve housing and being operable by movement of a valve control to disengage the hydraulic supply from the motor, the valve end of the cable being connected to the valve control and the sleeve being connected to the valve housing.

These and other aspects of the device are set out in the claims, which are incorporated here by reference.

BRIEF DESCRIPTION OF THE FIGURES

Embodiments will now be described with reference to the figures, in which like reference characters denote like elements, by way of example, and in which.

DETAILED DESCRIPTION

Immaterial modifications may be made to the embodiments described here without departing from what is covered by the claims. In the claims, the word "comprising" is used in its inclusive sense and does not exclude other elements being present. The indefinite article "a" before a claim feature does not exclude more than one of the feature being present. Each one of the individual features described here may be used in one or more embodiments and is not, by virtue only of being described here, to be construed as essential to all embodiments as defined by the claims.

Figure 1:
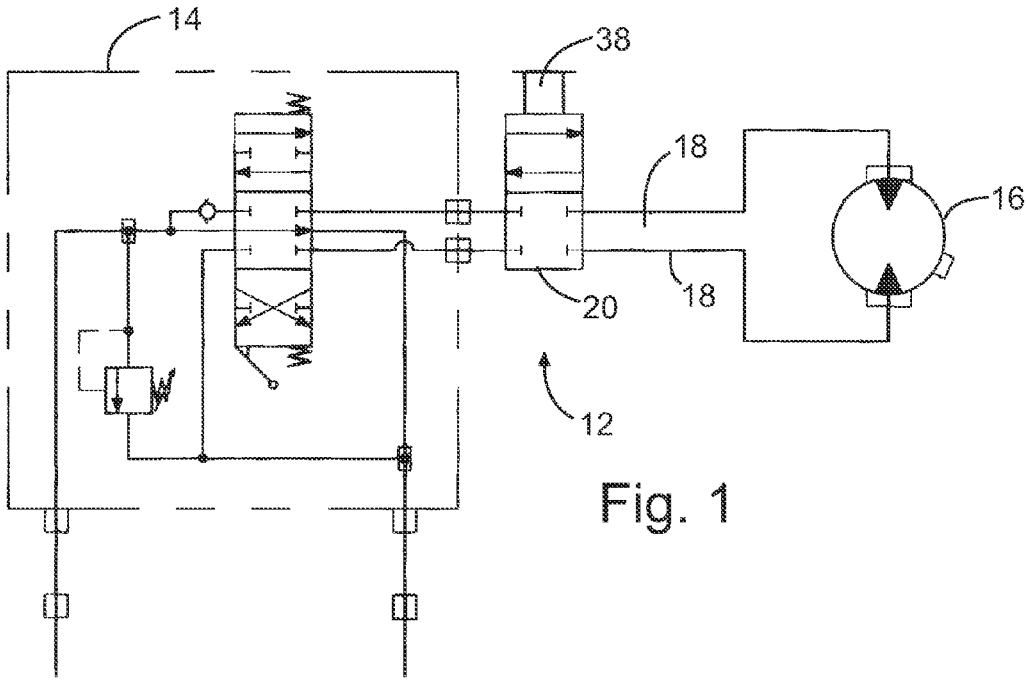
FIG. 1 shows a hydraulic circuit for a power tong.
Figure 2:
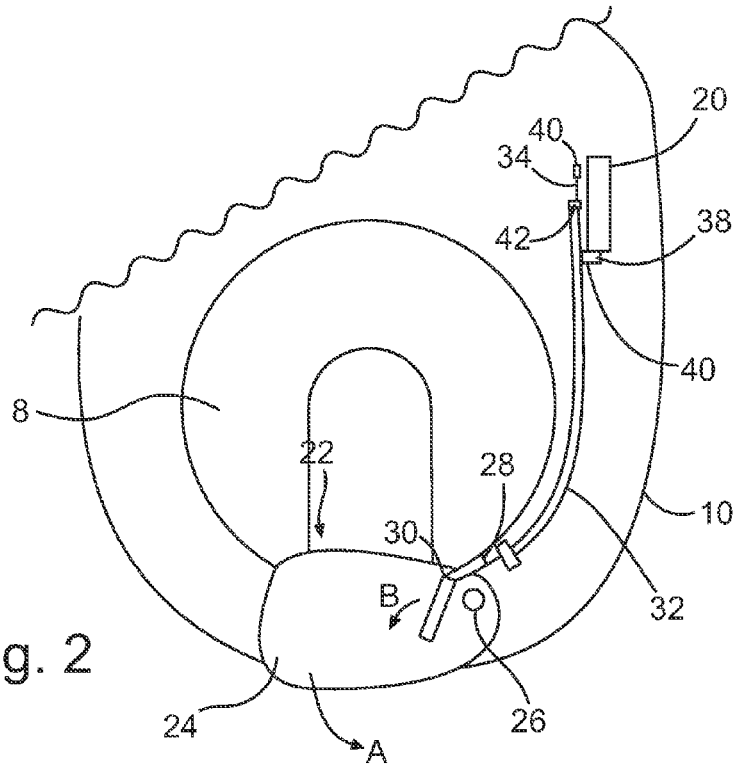
FIG. 2 shows a ring gear and cage assembly of a power tong.
Figure 3:
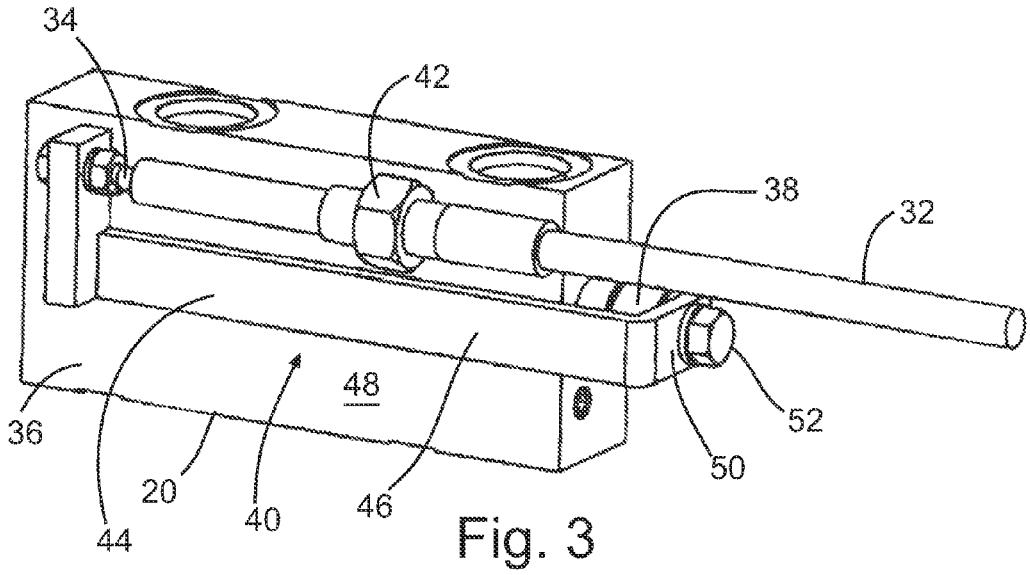
FIG. 3 shows a cable operated door jammer valve for use with the ring gear and cage assembly of FIG. 2.

Referring to FIGS. 1 and 2, a power tong 10 comprises a conventional ring gear and cage assembly 8 (FIG. 2) and hydraulic power circuit 12 (FIG. 1). The hydraulic power circuit 12 comprises a hydraulic supply 14 that supplies hydraulic fluid to motor 16 through lines 18. A shut off valve 20 is provided on the lines 18. The ring gear and cage assembly 8 has a throat 22 and the ring gear and cage assembly 8 is driven by the motor 16. The cooperation of the ring gear and cage assembly with the motor is known in the art and need not be described further here.

A door 24 is mounted on a pivot 26 on the ring gear and cage assembly 8 for movement to open and close the throat 22. A cable 28 is secured to the door 24 at a connection point 30 that is offset from the pivot 26. The cable 28 extends through a sleeve 32 to a valve end 34 of the cable 28. The sleeve 32 may be secured at various points along the power tong body 10.

The valve 20 is located on the power tong body 10 away from the throat 22 at the rear of the ring gear and cage assembly 8 and adjacent the hydraulic supply 14. The valve 20 is at the valve end 34 of the cable 28 and has a valve housing 36. The valve 20 is operable by movement of a valve control 38 to disengage the hydraulic supply 14 from the motor 16. The valve 20 is a conventional shut off valve in one embodiment, and may be a diverter valve in another embodiment. The valve end 34 of the cable 28 is connected to the valve control 38 via a rigid linkage 40. The sleeve 32 is connected and secured to the valve housing 36 by any of suitable means such as by welding nut 42 to the housing 36 of the valve 20.

The linkage 40 through which the cable 28 is connected to the valve control 38 may comprise in one embodiment a drive rod 44 having a main section 46 lying parallel to a wall 48 of the valve housing 36 and having an extension 50 extending laterally to the main section 46 to a connection point 52 with the valve control 38.

When the door 24 is opened in the direction of arrow A to open the throat 22, the connection point 30 rotates around the pivot 26 as shown by arrow B, thus pulling on the cable 28. The cable 28 moves through fixed sleeve 28 and pulls on the linkage 40, which pulls on the valve control 38 to operate the valve 20 and shut off hydraulic fluid supply to the motor 16.

The embodiments of the invention in which an exclusive property or privilege is claimed are defined as follows:

1. A power tong, comprising:

a ring gear and cage assembly having a throat, the ring gear and cage assembly being driven by a motor having a hydraulic supply;

a door mounted on a pivot on the ring gear and cage assembly for movement to open and close the throat;

a cable secured to the door at a point that is offset from the pivot, the cable extending through a sleeve to a valve end of the cable;

a valve at the valve end of the cable, the valve having a valve housing and being operable by movement of a valve control to disengage the hydraulic supply from the motor;

the valve end of the cable being connected to the valve control; and the sleeve being connected to the valve housing.

2. The power tong of claim 1 in which the cable is connected to the valve control through a drive rod having a main section lying parallel to a wall of the valve housing and having an extension extending laterally to the main section to a connection point with the valve control.

* * * * *

UNITED STATES PATENT AND TRADEMARK OFFICE

CERTIFICATE OF CORRECTION

PATENT NO. : 8,418,586 B2
APPLICATION NO. : 12/862616
DATED : April 16, 2013
INVENTOR(S) : K. R. Feigel, Jr. et al.

It is certified that error appears in the above-identified patent and that said Letters Patent is hereby corrected as shown below:

| COLUMN | LINE | ERROR |
|---|---|---|
| (73) Title Page, col. 1 | Assignee | "Universe Machines Corporation" should read --Universe Machine Corporation-- |
| Title Page, col. 1 | Foreign Appln. Priority Data | Before the line beginning with "[51] Int. Cl." please insert: --[30] Foreign Application Priority Data June 4, 2010 Canada 2705468-- |

Signed and Sealed this
Twenty-fourth Day of September, 2013

Teresa Stanek Rea
*Deputy Director of the United States Patent and Trademark Office*